United States Patent [19]

Muller et al.

[11] Patent Number: 4,478,926

[45] Date of Patent: Oct. 23, 1984

[54] ZINC SULFONATES AND THEIR USE IN DIAZOTYPY

[75] Inventors: Peter Muller; Henry Mustacchi, both of Port Washington, N.Y.

[73] Assignee: Andrews Paper & Chemical Co., Inc., Port Washington, N.Y.

[21] Appl. No.: 468,173

[22] Filed: Feb. 22, 1983

Related U.S. Application Data

[62] Division of Ser. No. 334,722, Dec. 28, 1981, abandoned.

[51] Int. Cl.[3] ..... G03C 1/60

[52] U.S. Cl. ..... 430/178; 430/148; 430/149; 430/150; 430/157; 430/171; 430/172

[58] Field of Search ..... 430/171, 172, 178, 151, 430/148, 149, 150; 260/142

[56] References Cited

U.S. PATENT DOCUMENTS

| | | | |
|---|---|---|---|
| 2,402,106 | 6/1946 | Von Glahn et al. | 260/142 |
| 2,496,240 | 1/1950 | Von Glahn et al. | 430/171 |
| 2,612,495 | 9/1952 | Von Glahn et al. | 260/142 |
| 2,694,010 | 11/1954 | Botkin et al. | 430/178 |
| 3,102,812 | 9/1963 | Welch | 430/171 |
| 3,153,592 | 10/1964 | Klimkowski et al. | 430/151 |
| 3,298,834 | 1/1967 | Eldred et al. | 430/178 |
| 3,529,964 | 9/1970 | Kienast et al. | 430/178 |
| 3,607,275 | 9/1971 | Sus et al. | 430/178 |
| 4,403,028 | 9/1983 | Mustacchi et al. | 430/178 |

FOREIGN PATENT DOCUMENTS

| | | | |
|---|---|---|---|
| 931414 | 8/1973 | Canada | 430/178 |

*Primary Examiner*—Charles L. Bowers, Jr.
*Attorney, Agent, or Firm*—Kane, Dalsimer, Kane, Sullivan and Kurucz

[57] ABSTRACT

Zinc salts of sulfonic acids are described as stabilizers for diazotype materials.

24 Claims, No Drawings

ZINC SULFONATES AND THEIR USE IN DIAZOTYPY

This is a division of application Ser. No. 334,722, filed Dec. 28, 1981, abandoned.

BACKGROUND OF THE INVENTION

1. Field of the Invention

The invention relates to zinc salts of sulfonic acids and their use in diazotypy.

2. Brief Description of the Prior Art

The diazotype reproduction process is well-known to the art and is described in great detail in "Light Sensitive Systems" by Jaromir Kosar, John Wiley & Sons, Inc., N.Y. 1965, and in "Reproduction Coating" by E. Jahoda, 4th Edition, Andrews Paper & Chemical Co., Inc., Port Washington, N.Y.

In general, diazotype reproduction prints are obtained by an imagewise exposure of a light-sensitive diazo material to ultraviolet light followed by development of the exposed diazotype material. There are several different methods available to develop the latent image imposed on the light-sensitive diazo material by the light exposure including ammonia development, amine development, thermal development and moist (liquid) development.

The light-sensitive diazomaterial generally comprises a light-sensitive diazo composition affixed to a support base such as paper or film such as polyethylene terephthalate film, cellulose acetate, or a polymeric resin coated, like base support. The light-sensitive diazo composition may comprise a light-sensitive diazonium salt compound in admixture with diazo enhancing compounds. Upon exposure of the light-sensitive diazonium compound to ultraviolet light through a translucent original having opaque image portions, the unmasked portions of the diazonium salt are decomposed by the ultraviolet radiation whereas the masked portions are left undecomposed. The latent image created by the image-wise exposure may then be developed by the methods described above.

In the so-called "dry development" process, the light-sensitive diazo composition will contain, in addition to the light-sensitive diazonium salt, an azo coupling agent or color former and an acidic coupling inhibitor. Development of the latent azo dye image is accomplished by placing the exposed diazo material in an alkaline atmosphere which neutralizes the acidic inhibitor, allowing the undecomposed diazonium salt and coupler to react. The latent image is thereby developed.

In the moist development process (also called the one-component process) the light sensitive diazo composition contains essentially the diazonium salt compound. After image-wise exposure, development of the latent azo dye image is accomplished in a pH adjusted solution containing at least one coupler to react with the undecomposed diazonium salt.

It is of great importance in both of the above described processes that print development is obtained rapidly and that a minimum of premature development and other deterioration of diazotype materials occur during the time between their manufacture and their use.

Unfortunately, most diazo compounds have low stability and tend to decompose quickly. The coupling reaction unavoidably begins and continues at a very slow rate, immediately after the manufacture of the diazotype materials (i.e., precoupling). Consequently, their shelf life is very limited unless efficient stabilizers are added to delay or block such reactions.

Previously known stabilizers for diazotype materials have several drawbacks. For example, they tend to slow the coupling reaction even during development when it is supposed to occur rapidly. They also may adversely influence the developed image appearance by reducing brilliance and shifting color shades. Many stabilizers are not compatible with diazo coating solutions because they rapidly form insoluble salts or complexes with diazo compounds or couplers.

Conventional stabilizers used for diazotype materials are generally acids, such as boric acid, citric acid, tartaric acid and the like or inorganic acid salts such as zinc sulfate, aluminum sulfate, zinc chloride and the like. The free acids, in relatively low concentrations tend to slow the rate of development by lowering the pH. The stronger free acids render many conventional coated substrates brittle.

Zinc chloride is among the most widely used of stabilizers in diazotype materials. Its presence stabilizes diazo compounds against decomposition and is very effective against precoupling. However, the concentration of zinc chloride required for stabilization has many drawbacks. For example, it tends to precipitate most diazos as well as many couplers from their solutions. Its presence also inhibits print surface wetting by the developer solution in the moist processes. Its presence may also inhibit coupling of diazotypes in amine type of development and in the thermal type development processes. It may also render the diazo coating layer tacky because of its pronounced hygroscopic character.

Alkali salts of aromatic sulfonic acids are very effective stabilizers for diazo materials despite their being close to a neutral pH since they form sulfonic acid salts with the diazonium ion. However, these diazonium salts often have very limited solubility and thus precipitate from the sensitizing solution. Another drawback of alkali salts of aromatic sulfonic acids is that their presence slows the rate of image development considerably.

The present invention obviates many of the prior art problems and provides diazotype materials having good shelf life and a faster rate of image development. These objectives are accomplished by employing a new class of stabilizers having improved compatibility with diazotype sensitizing solutions. They do not unduly inhibit print dye coupling during the image development process. The invention revolves around the discovery that zinc salts of sulfonic acids can be used to stabilize diazotype coatings with particular advantages over prior art stabilizers. They are suprisingly compatible with diazotype coating solutions. Higher concentrations of stabilizer may be employed for better stabilization. They also do not inhibit the wetting of the print surface by the developer solution in the case of moist developed diazotype processes, do not inhibit amine development, and provide coating layers that are much less hygroscopic and thus pass more easily through hot ammonia developing machines.

In comparison to alkali salts of sulfonic acids, zinc salts of sulfonic acids are superior diazo stabilizers because they provide better diazotype coating solution compatibility, faster rate of development, and better print background stability (preventing discoloration).

Other advantages of the present invention include improved continuous coating coverage. Print exposure latitude may be improved through complete or partial replacement of zinc chloride stabilizer with zinc salts of sulfonic acids.

Another advantage is that the presence of the zinc salts of sulfonic acids as stabilizers provide more neutral (less pink) shades in blackline diazotypes.

Still another advantage is found in that presence of zinc salts of sulfonic acids in diazotype materials used for ammonia development processes provides print colors that are more stable to pH variations and their hues change much less between development and the time when all excess ammonia has been dissipated. This improved pH stability of prints is of particular importance with blackline and redline diazotype materials.

Another advantage discovered is that the use of zinc salts of sulfonic acid as a stabilizer instead of zinc chloride or 1, 3, 6-1, 3, 7-naphthalene trisulfonic acid in diazotypes for amine development spectacularly increases the rate of image development while providing for good shelf life stability.

We found, moreover, the zinc salts of sulfonic acids are soluble in polaric organic solvents and compatible with polymeric resins such as cellulosic esters and that they are excellent stabilizers for diazotype film coating compositions, not exuding from the coating layer upon print ageing.

While the reasons for the above and other beneficial effects of the zinc salts of sulfonic acids are not fully understood, it is believed that the polaric structure of the zinc salts of sulfonic acids of this invention have a solubilizing effect that improves coating solution stability and wetting out of the precoated or non-precoated base paper surface with the sensitizing solution. Also, the simultaneous presence of zinc ions and sulfonic acid ions seem to have a synergistic effect with respect to improving shelf life stability against precoupling and diazo decomposition, without inhibiting the coupling rate during development. Moreover, the almost neutral but very slightly acidic pH of the zinc salts of sulfonic acids of the invention improves buffer capacity, minimizing print background discoloration when prints are kept under alkaline or acidic atmospheric conditions.

SUMMARY OF THE INVENTION

The invention comprises the use of zinc salts of sulfonic acids, as stabilizers in diazotype reproduction materials and the diazotype materials improved by their presence. The invention also comprises certain novel zinc salts of sulfonic acids.

The term "sulfonic acid" is used herein in its commonly accepted sense as meaning a compound having a group of the formula —$SO_2$—OH and includes amidosulfonic acids such as sulfamic acid.

DETAILED DESCRIPTION OF THE PREFERRED EMBODIMENTS OF THE INVENTION

Representative of the compounds used in the invention are those of the schematic formula:

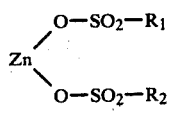

(I)

wherein each of $R_1$ and $R_2$, when taken independently, represents hydrocarbyl, hydrocarbyl substituted with an inert chemical group, or a group of the formula:

$$—NH—R_3 \quad (II)$$

wherein $R_3$ is hydrogen or $R_1$ as previously defined; and when taken together, $R_1$ and $R_2$ represent a divalent moiety selected from the group consisting of alkylene, arylene and cycloalkylene.

The term "hydrocarbyl" is used throughout the specification and claims as meaning the monovalent moiety obtained by removal of a hydrogen atom from a parent hydrocarbon, which latter, for example, contains 1 to 12 carbon atoms. Illustrative of such moieties are alkyl of 1 to 12 carbon atoms, inclusive, such as methyl, ethyl, propyl, butyl, pentyl, hexyl, heptyl, octyl, nonyl, decyl, undecyl, dodecyl and isomeric and or unsaturated forms thereof; cycloalkyl of 3 to 8 carbon atoms, inclusive such as cyclopropyl, cyclobutyl, cyclopentyl, cyclohexyl, cycloheptyl, cyclooctyl and the like; aryl of 6 to 12 carbon atoms, inclusive, such as phenyl, tolyl, xylyl, naphthyl, biphenylyl and the like, aralkyl of 7 to 12 carbon atoms, inclusive, such as benzyl, phenethyl, phenpropyl, phenbutyl, phenpentyl, phenhexyl and the like.

The term "hydrocarbyl substituted with an inert chemical group" as used herein means hydrocarbyl as defined above, wherein one or more hydrogen atoms have been replaced with a chemical group which will not adversely affect the use of the compound of formula (I) to stabilize diazotype compositions. Representative of such groups are halogen and hydroxyl.

The term "halogen" as used herein is embracive of chlorine, bromine and iodine.

The term "alkylene" is used herein to mean the divalent moiety obtained upon removal of two hydrogen atoms from a parent hydrocarbon. Representative of alkylene are alkylene of 1 to 8 carbon atoms, inclusive, such as methylene, ethylene, propylene, butylene, pentylene, hexylene heptylene, octylene, and the like.

The term "cycloalkylene" as used herein means the divalent moiety obtained upon removal of a hydrogen atom from each of two nonadjacent carbon atoms in a parent hydrocarbon. Representative of cycloalkylene are 1, 4-butylene, 1-5, pentylene, 1,6-hexylene, 1, 7-heptylene, 1,8-octylene and the like.

The term "arylene" as used herein means the divalent moiety obtained upon removal of a hydrogen atom from a monovalent "aryl" moiety as defined above. Representative of arylene are 1,2-phenylene, 1,4-phenylene, 1,7 naphthylene and the like.

Representative of the compounds of the formula (I) given above are zinc p-toluene sulfonate, zinc o-toluene sulfonate, zinc m-benzene disulfonate, zinc p-phenol sulfonate, zinc 5-sulfosalicylate, zinc methanesulfonate, zinc 1-hydroxy butane-4-sulfonate, zinc chloroethane sulfonate, zinc methallyl sulfonate, zinc sulfamate, and zinc cyclohexyl sulfamate. Preferred compounds (I) used in the invention are selected from the group consisting of:

1. zinc sulfonates and disulfonates of aliphatic hydrocarbons containing 1-4 carbons and their substituted, multi-substituted, and multi-hetero-substituted analogs; halogen hydroxyl and carboxyl derivatives, and their various isomeric forms.

2. zinc sulfonates and disulfonates of benzene and its substituted, multi-substituted, and multi-hetero-substituted analogs; halogen, hydroxyl, carboxyl, and alkyl derivatives, and their various isomeric forms.

3. zinc sulfamates (i.e. compounds having the combined formulae (I) and (II), supra) of aliphatic and alicyclic hydrocarbons containing 1-6 carbons and their substituted, multi-substituted, and multi-hetero-substituted analogs; halogen, hydroxyl and carboxyl derivatives and their isomeric forms.

The compounds (I) may be prepared by reacting stoichiometric (equivalent) proportions of zinc oxide or zinc carbonate with the corresponding and appropriate free sulfonic acid, in aqueous medium. The reaction may be represented schematically in the formulae:

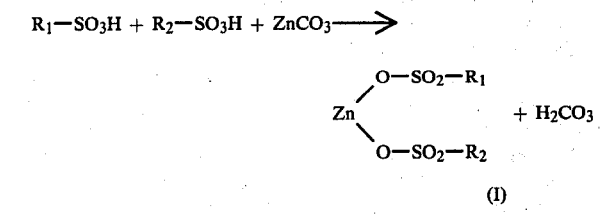

(I)

wherein zinc carbonate is selected as a reactant, $R_1$ and $R_2$ are as previously defined and the formulae (III) and (IV) represent sulfonic acids such as methyl sulfonic acid, p-toluene sulfonic acid, cyclohexyl sulfonic acid, sulfamic acid, cyclohexyl sulfamic, and the like. The starting sulfonic acid compounds of the formula (III) or (IV) are well known compounds as is the method of their preparation.

The above-described reaction for the preparation of the compounds (I) may be carried out using conventional reaction vessels, apparatus and technique. The reaction proceeds over a wide range of temperatures and pressures, preferably at atmospheric pressure and between room temperature and 105° C. In general, the preferred compounds (I) are crystalline solids at room temperatures and they may be separated from the reaction mixture by conventional techniques such as by crystallization, filtration, and like techniques. Alternatively, those compounds (I) which do not readily crystallize, may be prepared in-situ, in the liquid diazotype compositions of the invention.

The invention also comprises the method of using the compounds (I) in diazotype reproduction materials (compositions) of the invention.

As is well-known in the art, diazo compositions for the two-component diazotype process comprise at least one light-sensitive diazonium compound, at least one azo coupler and acidic stabilizers which are necessary to obtain a diazotype copy. In the diazotype coating compositions of the present invention, any of the conventionally employed, light-sensitive diazonium compounds may be employed. Aromatic para amino and para mercapto substituted diazo compounds of more or less pronounced yellow color and which absorb ultraviolet light to undergo a photolytic decomposition to colorless products are advantageously used. Such diazonium compounds and the method of their preparation are well known in the art. Representative of diazonium compounds used in the invention are:

1. Derivatives of 1-diazo-4-amino benzene with or without alkyl, oxyalkyl or halogen subsitutions in the benzene ring and with alkyl or dialkyl or acyl or acyl-alkyl or aryl substitution on the amino nitrogen or with the amino nitrogen forming a member of a heterocyclic ring with or without a second hetero atom of oxygen or nitrogen.

2. Derivatives of 1-diazo-4-alkylaryl mercapto benzene with or without substitution in the benzene ring.

3. Derivatives of 1-diazo-4-phenyl benzene with and without substitution in the phenyl and in the benzene rings.

4. 2-diazo-1-hydroxy-naphthalene-5-sulfonic acid, and the like.

In preferred compositions of the invention, azo couplers are mixed with the diazonium compounds in an acid environment to prevent precoupling. When changing the pH from an acid to an alkaline pH, the coupling reaction occurs to produce an azo dye as is known in the art. Azo couplers are generally aromatic compounds with phenolic hydroxyl groups with or without other substituent groups. The couplers are generally colorless. Representative of azo couplers are:

1. resorcinol and its halogen and alkyl derivatives and ethers;
2. resorcyclic acids with or without halogen substitution in the ring and their amides and substituted amides;
3. dihydroxy naphthalene mono sulfonic acids and disulfonic acids;
4. dihydroxy naphthalenes;
5. beta and alpha-hydroxy naphthoic acid amides and substituted amides;
6. compounds with active methylene groups such as aceto-acet derivatives and cyano-acet derivatives;
7. mono and poly hydroxy biphenyls;
8. polyhydroxy biphenyl sulfides;
9. pyrazolone derivatives;
10. amino phenol derivatives; and the like.

The proportions of the various components of the compositions of the invention described above may be those proportions conventionally used in their use prior to this invention, in the preparation of prior art diazo light-sensitive compositions (where they were so used). These proportions are well known to those skilled in the art; see for example the disclosures of Kosar, supra. and of U.S. Pat. Nos. 3,923,518 and 3,996,056. In general, the aqueous diazo coating compositions contain from about 0.1 to about 10 percent by weight of the light-sensitive diazonium compound and sufficient coupler to react with and couple the diazonium compound upon development.

A necessary ingredient of the diazo coating compositions of the invention, is a stabilizing proportion of a zinc salt of a sulfonic acid, for example a compound of the formula (I) given above. A stabilizing proportion is one which will maintain the desired acid pH of the diazo coating until development occurs. In general, a stabilizing proportion of the compounds of the invention as represented by those of the formula (I) given above, will be within the range of from about 5 gms to about 200 gms (preferably 20 gms to 70 gms) of the zinc salt of the sulfonic acid for each liter of aqueous diazo coating composition to be stabilized. The compounds (I) may be used as the sole stabilizer, or they may be used in conjunction with previously known acid stabilizers employed in diazotypy. Representative of such prior art acid stabilizers are citric acid, tartaric acid, hydrochloric acid, sulfuric acid, boric acid, mixtures thereof and the like.

The light-sensitive diazo coating compositions of the invention may contain any number of additional ingredients conventionally used in the preparation of prior art light-sensitive diazo coating compositions such as, for example, 1. development accelerators such as glycerol, polypropylene glycol, urea and the like to minimize the necessary ammonia or amine concentration in the developing environment;

2. antioxidants such as thiourea, glucose and the like to stabilize diazotype prints against discoloration under daylight exposure;

3. contrast controlling compounds; and 4. solubilizers such as caffein which improve the compatibility of the various components in the sensitizing solution.

Sometimes such components fulfill more than one of these functions.

In one-component diazotype reproduction materials, the diazo composition layer contains the diazonium compound, the stabilizer compound of the formula (I) given above, and other auxiliary agents such as those mentioned above, but without the azo coupling component. A developing solution, alkaline or neutral, containing highly reactive coupling components such as phloroglucinol and resorcinol and buffer salts, such as sodium borate or sodium formate, is applied to the diazotype material after image exposure to effect development of the print.

The diazo compositions of the invention may be prepared by bringing the ingredients together in a suitable vessel. Preferably the diazo compositions of the invention are prepared in an aqueous media for use as an aqueous coating mixture to prepare diazotype reproduction materials of the invention. In case of precoating it is possible to add one or more components to a precoat preparation and at least one of the remaining components of the compositions of this invention to a secondary coating preparation.

The diazotype reproduction materials of the invention may be prepared by coating aqueous mixtures of the diazo compositions of the invention on a suitable base support material, using conventional diazo coating apparatus. The techniques are well known; see for example U.S. Pat. Nos. 3,923,518 and 3,996,056. Representative of suitable base supports are thermoplastic, polymeric resin films, foils including metal foils, cloth, opaque paper, translucent papers and like supports. Preferred are the commercially available diazobase papers.

The following examples describe the manner and method of making and using the invention and set forth the best mode contemplated by the inventors but are not to be construed as limiting. All parts specified are by weight unless otherwise stated.

Where specified, test results were obtained by the following procedures.

TEST #1—DAYLIGHT DISCOLORATION OF PRINT BACKGROUND

A diazotype sheet is exposed to UV light in the printing section of a diazotype copying machine to decompose all the diazo containing in the sheet. It is then exposed to ammonia by passing it through the developing section of the machine. The sheet is then partly covered with a black opaque sheet and exposed in this form to daylight by taping the sheet to a window pane and leaving it for 3 to 7 days, depending on the season. In order to compare the performance of different diazotype materials, a number of diazotype sheets to be tested are taped together, treated in the same way as described above and exposed together in the window at the same time. After removing the test sheets from the window and separating the black opaque sheet, the reflection densities of the exposed area and of the covered area are compared with each other.

Comparing the print background of different diazotype materials permits rating of their resistance to discoloration.

TEST #2—ACCELERATED AGING TEST

Diazotype sheets are exposed for 24 hours at 50° C. to atmosphere of 50% and 75% relative humidity. This is done by suspending sample sheets of sensitized diazotypes in a closed box over a supersaturated solution of potassium carbonate (50% R.H.) and in another closed box over a supersaturated solution of sodium chloride (for 75% R.H.); and the boxes being placed inside an oven at 50° C. Thereafter they are half covered with a black opaque sheet and exposed to UV light in the printing section of a diazo copying machine, sufficiently to decompose all diazo in the non-covered area. The sheets are then fully developed with ammonia by passing the diazotype sheet through the developing section of a diazotype copying machine. A fresh sheet of the same diazotype paper is also half covered with a black opaque sheet and printed and developed in the same manner. The resulting prints are then compared as to their loss of full tone print color density and discoloration of their print background brightness in the light exposed areas. The loss of print color and the degree of print background discoloration are an indication of their useful shelf life. The aging test with a 50 percent relative humidity (R.H.) atmosphere, in general, reflects a normal shelf life of 3 months. The aging test with a 75 percent R.H. atmosphere reflects behaviour under extremely adverse conditions.

TEST #3—PRINT COLOR SHADE AND BRILLIANCY

Diazotype materials are manufactured in different color grades such as blue, black, red and others. The print color quality is indicated by its optical density and by its shade and its brilliancy or hue. The optical density can be measured with a reflection densitometer. The brilliancy or hue is judged visually by comparing print colors obtained under normal developing conditions as specified in Federal Specification UUP 221 and may range from dull to highly brilliant shades.

EXAMPLE 1

This is not an example of the invention but is made for comparative purposes.

On a 3 airknife station diazotype coating machine for precoating, sensitizing, and backcoating equipped with high velocity hot air drying passes after each coating, a diazo base paper of 72 g/m$^2$ basis weight is consecutively treated on the felt side with:

(1) a precoat composition of:

| | |
|---|---|
| non colloidal silicas of 1 micron particle size | 20 g |
| non cooked rice starch | 100 g |
| vinyl acetate copolymer | 60 ml. |
| antifoaming agent | 1 ml. |
| water enough to make | 1000 ml. |

(2) sensitizing solution of the following composition:

| | |
|---|---|
| sulfuric acid (98%) | 0.25 g |
| caffeine | 10 g |
| naphthalene 1,3,6-1,3,7 trisulfonic acid sod. salt | 40 g |
| 1-diazo-2,5-diethoxy-4-p-tolymercapto-benzene chloride (½ zinc chloride) | 1.5 g |
| 1-diazo-2-chloro-5-(4'-chlorophenoxy)-4-N,N—diethyl amino-benzene chloride (½ zinc chloride) | 15 g |
| water to complete to: | 1000 ml. |

and on the wire side (3) a backcoating solution for curl control:

| | |
|---|---|
| zinc chloride | 40 g |
| citric acid | 5 g |
| water to complete to: | 1000 ml. |

The coated and dried diazotype paper is then wound up and cut into sheets of 8½×11 inch for testing. An image test exposure of the sensitized and cut paper is made behind a standard step wedge producing full tone print areas, intermediate tone areas and areas in which all diazo has been decomposed.

Sheet samples are then processed in a typical commercial diazotype printer such as Bruning Copyflex Model 250. They were imagewise exposed and then developed with the following solution:

| | |
|---|---|
| sodium formate | 60 g |
| sodium benzoate | 15 g |
| phloroglucinol | 4 g |
| non ionic wetter | 0.3 g |
| water to complete to: | 1000 ml. |

Prints made from paper from Example #1 supra., developed to deep black full tones. The intermediate tones showed pronounced pink shades and the full exposed areas appeared slightly yellowish.

EXAMPLES 2-5

The procedure of Example #1 is repeated except for the composition of coating No. 2 which is varied as follows to illustrate the effect of increasing concentration of zinc p-toluene sulfonate and lower pH:

| | #2 | #3 | #4 | 5 |
|---|---|---|---|---|
| sulfuric acid (98%) | 0.25 g | | | — |
| p-toluene sulfonic acid | — | — | — | 5 g |
| caffeine | 10 g | | | |
| zinc p-toluenesulfonate | 20 g | 40 g | 60 g | 40 g |
| 1-diazo-2,5-diethoxy-4-p-tolymercapto-benzene chloride (½ zinc chloride) | 1.5 g | | | |
| 1-diazo-2-chloro-5-(4'-chlorophenoxy)-4-N, N—diethyl amino-benzene chloride (½ zinc chloride) | 15 g | | | |
| water to complete to | 1000 ml. | | | |

Test exposures are made and developed in samples of Examples #2,3,4, and 5, supra in the same manner as described in Example #1 and compared with a print from Example #1.

The prints developed to deep black full tones. The shades in the intermediate tones of Example #2 are much less pink and showed no pink but neutral grey shades in Examples #3, 4, and 5.

The fully exposed areas of the print from Example #1 have a slightly yellowish shade while the prints from Examples #2 through #5 showed a bright white background.

It was also noted that after contact with the developer solution, the print from Example #1 developes the print dye substantially slower than prints from Examples #2 through #5.

Sensitized sheets from Examples #1 through #5 are suspended for 24 hours in a closed container with an atmosphere of 75% R.H. at a temperature of 50° C. for an accelerated aging test (test #3 supra), and are printed and developed afterwards in the manner detailed above.

All prints show loss in the full tone densities and some discoloration in the fully exposed areas (print background).

Least loss in full tone density and least discoloration from the accelerated aging procedure are observed with prints from Example #4 (the sheet coated with the sensitizing solution having the highest concentration of zinc p-toluenesulfonate) and degrading in the order of Examples #5, #3, #1, #2.

EXAMPLES #6-#13

The procedure of Example #1 is repeated except for the composition of coating #2 which is varied as follows to compare the effectiveness of various known stabilizers with a stabilizer in accordance with the present invention (zinc p-toluene sulfonate):

| | #6 | #7 | #8 | #9 | #10 | #11 | #12 | #13 |
|---|---|---|---|---|---|---|---|---|
| sulfuric acid | 0.25 g | | | | | | | |
| 1-diazo-2,5-diethoxy-4-p-tolymercapto-benzene chloride (½ zinc chloride) | 12.5 g | | | | | | | |
| naphthalene 1,3, 6-1,3,7 trisulfonic acid, sod. salt | — | 40 g | 60 g | — | — | — | — | — |
| zinc p-toluene sulfonate | — | — | — | 40 g | 60 g | — | — | — |
| zinc sulfate | — | — | — | — | — | 40 g | — | — |
| aluminum sulfate | — | — | — | — | — | — | 40 g | — |
| zinc chloride | — | — | — | — | — | — | — | 40 g |
| water to complete | 1000 ml | | | | | | | |

-continued

| | #6 | #7 | #8 | #9 | #10 | #11 | #12 | #13 |
|---|---|---|---|---|---|---|---|---|
| to | | | | | | | | |

The solutions Examples #6–13 formulated in accordance with the above table have various consistencies: Examples #9, 10, 11 and 12 are clear while Example #6 is turbid, Example #7 shows partial precipitation and Example #13 completely precipitates.

Sheets from examples #6, 8, 9, 10, 11 and 12 are evaluated as in the preceding EXAMPLE with following results, rated from 1st (best) to 6th (worst):

| | Full tone color density and brilliance | Intermediate tones | Shelf Life | Print Background Discoloration | Rate of Development |
|---|---|---|---|---|---|
| Ex. #6 | 4th | pink | 6th (very poor) | pink | 3rd (fast) |
| #8 | 5th | pink | 3rd | slightly yellowish | 5th (very slow) |
| #9 | 2nd | neutral grey | 2nd | white | 1st (very fast) |
| #10 | 1st (best) (deepest color) | neutral grey | 1st (best) | white | 2nd (fast) |
| #11 | 3rd | pink | 5th | slightly yellowish | 4th (fair) |
| #12 | poorest (flat brownish color) | pink | 4th | slightly yellowish | 6th (very slow) (slowest) |

Evaluation of Examples #6 through #13 clearly indicates that incorporation of zinc toluene sulfonate (i.e. Examples #9 and #10) results in an improved performance of the one component diazotype over the use of conventional stabilizers such as naphthalene trisulfonic acid sodium salt, zinc sulfate, aluminum sulfate, zinc chloride or none.

EXAMPLES #14–18

The procedure of Example #1 is repeated except the composition of sensitizing coating #2 is replaced by sensitizing solutions having the following composition to compare effectiveness of various stabilizers made in accordance with the present invention and the effect of sodium substitution for zinc.

| | #14 | #15 | #16 | #17 | #18 |
|---|---|---|---|---|---|
| p-toluene sulfonic acid | 2.5 g | | | | |
| 1-diazo-2,5-diethoxy-4-p-tolymercapto-benzene chloride (½ zinc chloride) | 12.5 g | | | | |
| zinc p-toluene sufonate | — | 40 g | — | — | — |
| zinc sulfamate | — | — | 40 g | — | — |
| zinc methanesulfonate | — | — | — | 40 g | — |
| sodium sulfamate | — | — | — | — | 40 g |
| water to complete to | 1000 ml | | | | |
| solution consistency: | turbid | clear | clear | clear | clear |

Sheets from Examples #14 through #18 are evaluated as above with the following results; rated from 1st best to 5th worst:

| | Full tone color density and brilliance | Intermediate tones | Shelf Life | Print Background Discoloration | Rate of Development |
|---|---|---|---|---|---|
| Ex. #14 | (greenish black 5th | 5th (pinkish) | 5th (worst) | 5th (some tan discoloration) | 5th (slowest) |
| Ex. #15 | 1st (deep brilliant black) | 1st (neutral) | 1st (best) | 1st (white) (best) | 1st (best) |
| Ex. #16 | 3rd (deep black) | 3rd (very slightly (pinkish) | 3rd (medium) | 3rd | 2nd |
| Ex. #17 | 2nd (deep black | 2nd (neutral) | 2nd (medium) | 2nd | 3rd |
| Ex. #18 | 4th (flat black) | 4th (slightly pinkish) | 4th (fair) | 4th (very slightly tan) | 4th |

The comparison of the results from Examples #14 through #17 shows the improvements of performance regarding shelf life stability, print color value and development rate obtained from use of zinc salts of the invention.

The comparison of the results from Examples #16 and #18 indicates that the improved results are not obtained when the zinc salt is replaced by the sodium salt of sulfamic acid.

EXAMPLES #19–#21

The procedure of Example #1 is repeated except that the composition of coating #2 which is replaced by sensitizing solutions for standard speed blueline diazotypes as follows to illustrate the effect of stabilizers in accordance with the present invention on two-component diazotypes in both ammonia and amine development processes:

| | #19 | #20 | #21 |
|---|---|---|---|
| citric acid | 10 g | | |
| thiourea | 20 g | | |
| 2,3-dihydroxynapthalene-6-sulfonic acid | 17 g | | |
| diethylene glycol | 10 ml | | |
| isopropanol | 10 ml | | |
| zinc p-toluene sulfonate | 60 g | 30 g | — |
| zinc chloride | — | 30 g | 60 g |
| 1-diazo-4-N,N—diethylamino-benzene chloride (½ zinc chloride) | 18 g | | |
| saponin | 0.25 g | | |
| water to complete to | 1000 ml | | |

Sheets from Examples #19–21 are evaluated. They are printed and developed in commercial diazotype copiers with the following results:

| | Full tone color | Shelf Life | Rate of Development with hot ammonia | Rate of Development with cold ammonia | Rate of Development with amine development |
|---|---|---|---|---|---|
| Ex. #19 | Bright | very | very good | very good | very |

-continued

| | Full tone color | Shelf Life | Rate of Development with hot ammonia | Rate of Development with cold ammonia | Rate of Development with amine development |
|---|---|---|---|---|---|
| | blue | good (best) | (best) | (best) | good (best) |
| Ex. #20 | Slightly purplish blue | good | medium | medium | slow |
| Ex. #21 | purplish blue | fair to good | slower | slower | poor |

The results from the evaluation of tests #19 through #21 show that the replacement of zinc chloride by zinc toluene sulfonate not only improved shelf life stability and rate of development of the two component diazotypes for ammonia development, but also renders these two component diazotypes useful for both ammonia and amine development processes (i.e., universal development).

EXAMPLES #22–24

The procedure of Examples #19–#21 is repeated except that the composition of coating #2 which is replaced by sensitizing solutions for superfast blueline diazotypes as follows:

| | #22 | #23 | #21 |
|---|---|---|---|
| citric acid | 10 g | | |
| p-toluene sulfonic acid | 10 g | | |
| 1-diazo-3-methyl-4-pyrrolidino-benzene chloride (½ zinc chloride) | 10 g | | |
| caffeine | 5 g | | |
| thiourea | 30 g | | |
| 2,3 dihydroxynapthalene-6-sulfonic acid sodium salt | 15 g | | |
| dipropylene glycol | 10 cc | | |
| zinc chloride | — | 60 g | — |
| zinc p-toluene sulfonate | — | — | 60 g |
| saponin | 0.5 g | | |
| water to complete to | 2000 cc | | |
| Solution consistency after 24 hours: | clear | some sludge | clear |

Sheets from examples #22–24 are evaluated with the following results:

| | Full tone color | Shelf Life | Rate of Development with hot ammonia | Rate of Development with cold ammonia | Rate of Development with amine development | Print color stability in office atmosph. |
|---|---|---|---|---|---|---|
| Ex. #22 | flat lilac | poor | poor | poor | good | turns brownish |
| Ex. #23 | strong violet blue | good | good | good | very poor | turn flat and brownish |
| Ex. #24 | strong bright blue | good (best) | good | good | very good | least change best |

The results from Examples #22 through #24 show that superior superfast blueline diazotypes are obtained through replacement of the conventional zinc chloride stabilizer by a zinc salt of the invention. The copies keep their brilliant blueline color when exposed to the slightly acidic atmosphere in industrialized areas, while the blue color of conventional copies tend to shift towards dull brownish hues.

EXAMPLES #25–28

The procedure of Examples #19–#21 is repeated except that the composition of coating #2 is replaced by sensitizing solutions for superfast blueline diazotypes as follows:

| | #25 | #26 | #27 | #28 |
|---|---|---|---|---|
| citric acid | 10 g | | | |
| caffeine | 15 g | | | |
| 2-hydroxy napthalene-3-carboxylic acid-3'N—morpholino-propylamide | 12.5 g | | | |
| thiourea | 10 g | | | |
| zinc p-toluene sulfonate | — | 40 g | 20 g | — |
| zinc chloride | — | — | 20 g | 40 |
| isopropanol | 10 ml | | | |
| 1-diazo- 2,5-diethoxy-4-morpholino-benzene chloride (½ zinc chloride) | 16 g | | | |
| diethylene glycol | 5 ml | | | |
| saponin | 0.25 g | | | |
| water to complete to | 1000 ml | | | |
| Solution consistency: | darkens (precouples partly) | clear | clear | clear |

Sheets from Examples #25–#28 are evaluated with the following results:

| | Full tone color | Shelf Life | Rate of Development ammonia hot | Rate of Development ammonia cold | Rate of Development amine |
|---|---|---|---|---|---|
| Ex. #25 | dull blue | very poor | medium | medium | good |
| Ex. #26 | bright blue | good | very good (best) | very good (best) | good (best) |
| Ex. #27 | purplish blue | good | good | medium to good | medium |
| Ex. #28 | purple | good | good | fair (slowest) | fair (slowest) |

The results from the evaluation of Examples #25 through #28 show that more desirable bright blue print line shades and better universal development can be obtained from the full or partial replacement of zinc chloride by a zinc salt of the invention without any loss of shelf life stability.

EXAMPLES #29–#33

The procedure of Examples #19–#21 is repeated except for the composition of coating #2 which is replaced by sensitizing solutions for superfast blueline diazotypes as follows:

| | #29 | #30 | #31 | #32 | #33 |
|---|---|---|---|---|---|
| citric acid | 10 g | | | | |
| p-toluene sulfonic acid | 5 g | | | | |
| acetic acid | 10 g | | | | |
| 2-hydroynapthalene-3-carboxylic acid-3'N—morpholino-propylamide | 10 g | | | | |
| caffeine | 20 g | | | | |
| dipropylene glycol | 5 ml | | | | |
| zinc chloride | 30 g | — | — | — | — |
| zinc p-toluene sulfonate | — | 30 g | 60 g | | |
| zinc methane sulfonate | — | — | — | 30 g | 60 g |

-continued

| | #29 | #30 | #31 | #32 | #33 |
|---|---|---|---|---|---|
| 1-diazo-2,5-dibutoxy-4-morpholino-benzene disulphate (80%) | 15 g | | | | |
| thiourea | 10 g | | | | |
| saponin | 0.25 g | | | | |
| water to complete to | 1000 ml | | | | |
| Solution consistency: | precipitate | clear | clear | clear | clear |

Sheets from Examples #29–#33 are evaluated with the following results:

| | Full tone color | Shelf Life | Rate of Development Ammonia hot | cold | Amine |
|---|---|---|---|---|---|
| Ex. #29 | not coated | — | — | — | — |
| Ex. #30 | bright brilliant blue | very good | very good | very good | good (slowest) |
| Ex. #31 | bright brilliant blue | very good (best) | very good (best) | very good (best) | good |
| Ex. #32 | bright violet blue | good | good | good | very good |
| Ex. #33 | bright violet blue | good | good | good | very good (best) |

The results from Examples #29 through #33 show that zinc salts of the invention are very useful stabilizers for this system while zinc chloride proves incompatible and causes precipitation. 1-diazo-2,5-dibutoxy-4-morpholinobenzene chloride (½zinc chloride) is a very fast coupling diazo and thus it is a desirable sensitizer for rapid developing two component diazotypes for ammonia and amine development. It requires, however, strong stabilization to protect against precoupling.

EXAMPLES #34–#40

The procedure of Examples #19–#21 is repeated except that the composition of coating #2 which is replaced by sensitizing solutions for superfast redline diazotypes as follows:

| | #34 | #35 | #36 | #37 | #38 | #39 | #40 |
|---|---|---|---|---|---|---|---|
| toluene sulfonic acid | 17 g | | | | | | |
| acetic acid | 5 g | | | | | | |
| citric acid | 5 g | | | | | | |
| caffeine | 2.5 g | | | | | | |
| 2-hydroxynaphthalene-3-carboxylic acid diethanol amide | 3.5 g | | | | | | |
| 4-bromo- -resorcylic acid amide | 4 g | | | | | | |
| 1-diazo-3-methyl-4-pyrrolidono-benzene chloride (½ zinc chloride) | 10 g | | | | | | |
| thiourea | 30 g | | | | | | |
| allyl-hydroxyethyl-thiourea | 20 g | | | | | | |
| diethylene glycol | 10 ml | | | | | | |
| zinc chloride | — | 50 g | — | — | — | — | — |
| zinc p-toluene sulfonate | — | — | 50 g | 75 g | — | — | — |
| zinc methane sulfonate | — | — | — | — | 50 g | 75 g | — |
| sodium toluene sulfonate | — | — | — | — | — | — | 50 g |
| saponin | 0.25 g | | | | | | |
| water to complete to | 1000 ml | | | | | | |
| Solution consistency: | clear | some oily precipitation | clear | clear | clear | clear | clear |

Sheets from Examples #34–#40 are evaluated with the following results:

| | Full tone color | Shelf Life | Rate of Development hot ammonia | amine | Print stability in office atmosphere |
|---|---|---|---|---|---|
| Ex. #34 | flat brick red | 7th (poor) (worst) | 7th (slowest) | 6th (good) | very flat brick red |
| Ex. #35 | deep violet red | 4th (good) | 3rd (good) | 7th (poor) (slowest) | dull brown red |
| Ex. #36 | bright red | 3rd (very good) | 6th (good) | 2nd (very good) | bright red |
| Ex. #37 | brilliant bright red | 1st (very good) (best) | 2nd (very good) | 1st (very good) (best) | brilliant bright red |
| Ex. #38 | bright red | 5th (good) | 5th (good) | 3rd (good) | bright red |
| Ex. #39 | brilliant bright red | 2nd (very good) | 1st (fastest) | 5th (good) | brilliant bright red |
| Ex. #40 | flat brick red | 6th (poor) | 4th (good) | 4th (good) | very red flat brick red |

The results from Examples #34–#40 show that:

Zinc chloride provides for rather good shelf life at 5% concentration. However, concentration increases are impractical because of its limited solution compatibility.

The initial print color as an effect of zinc chloride is a deep violet red with good contrast. As the excessive ammonia dissipates and the print slightly reacidifies in an open atmosphere, the print color, however, turns to a dull reddish brown which is an undesirable shade for redline diazo prints.

Zinc chloride provides for acceptable rates of development under hot and cold ammonia exposure, but it substantially slows down amine development.

Sodium toluene sulfonate brings about a flat brick red print color, but it lacks the necessary stabilizing action for adequate shelf life and hardly contributes to the rate of development.

The zinc salts of toluene sulfonic acid and of methane sulfonic acid excel in their effects on shelf life improvement, on rate of development and print color stability without showing solution compatibility problems associated with zinc chloride.

EXAMPLES #41–#43

The procedure of Examples #19–#21 is repeated except that (1) a 100% rag intermediate base of 53 g/m$^2$ basis weight which is pretransparentized with a 25% polystyrene solution and the solvent is removed by evaporation is used and (2) coating #2 is replaced with sensitizing solutions for brownline diazotype intermediates as follows:

| | #41 | #42 | #43 |
|---|---|---|---|
| p-toluene sulfonic acid | 12.5 g | | |
| sulfosalicylic acid | 5 g | | |
| alpha resorcylic acid | 2.5 g | | |
| b-resorcylic acid ethanolamide | 15 g | | |
| 4-chlororesorcinol | 12.5 g | | |
| 1-diazo-4-N,N—dimethylamino benzene chloride (½ zinc chloride) | 40 g | | |
| thiourea | 10 g | | |
| zinc chloride | 60 g | 30 g | — |
| zinc p-toluene sulfonate | — | 30 g | 60 g |
| isopropanol | 20 cc | | |
| saponin | 0.25 g | | |
| water to complete to | 1000 ml | | |
| Solution consistency: | clear | clear | clear |

| | Full tone color | Shelf Life | Rate of Development Ammonia | Rate of Development Amine | Reprint Opacity |
|---|---|---|---|---|---|
| Ex. #41 | dull brown | fair to good | good | poor | good |
| Ex. #42 | medium brown | good | good | poor to fair | good |
| Ex. #43 | brilliant brown | very good (best) | very good (best) | good | good (best) |

The results of Examples #41–#43 show that a replacement of zinc chloride by zinc toluene sulfonate in the diazotype intermediate not only improves shelf life, but makes a diazotype material useful for both ammonia and amine development.

EXAMPLES #44–#46

The procedure of Examples #19–#21 is repeated except for the composition of coating #2 is replaced with sensitizing solutions for superfast blackline diazotypes as follows:

| | #44 | #45 | #46 |
|---|---|---|---|
| citric acid | 15 g | | |
| acetic acid | 10 ml | | |
| p-toluene sulfonic acid | 2.5 g | | |

-continued

| | #44 | #45 | #46 |
|---|---|---|---|
| caffeine | 5 g | | |
| zinc methane sulfonate | 20 g | 10 g | — |
| zinc p-toluene sulfonate | 45 g | 22.5 g | — |
| zinc chloride | — | 32.5 g | 65 g |
| thiourea | 30 g | | |
| 2 hydroxynapthalene-3-carboxylic acid-3'N—morpholino-propylamide | 2 g | | |
| 2,7-dihydroxynaphalene-3,6-disulfonic acid disodium salt | 9 g | | |
| 1,10- dicyancacer-triethylene tetramine HCL salt | 12.5 g | | |
| trihydroxydiphenyl, 50% aqueous solution | 2.5 g | | |
| isopropanol | 15 cc | | |
| 1-diazo-2,5-diethoxy-4-morpholino benzene chloride (½ zinc chloride) | 27 g | | |
| saponin | 0.25 g | | |
| water to complete to | 1000 ml | | |
| Solution consistency: | clear | clear | clear |

Sheets from Examples #44, #45, and #46 are evaluated as above with the following results:

Shelf life and ammonia rate of development tests give satisfactory and equally good results for all three examples.

Upon ammonia development, the print color hues from the low density areas over the medium density areas to the full density areas went from a light neutral grey over a deeper neutral grey to a deep neutral black on prints of Example #44. The corresponding print colors from Example #46 go from a light neutral grey over a deeper purplish blue to a deep reddish black.

The corresponding print colors from Example #45 developed to shades between the ones from Example #44 and #46.

Desirable shades of blackline diazotypes are neutral greys and a deep neutral black. Most additives to blackline diazotype compositions tend to cause differential color shifting in lower and higher density areas of the prints producing undesirable bi-tonal effects. Such is the effect of zinc chloride which otherwise is considered as a necessary stabilizer.

It has been fully unexpected that the zinc salts of sulfonic acids produced prints with neutral grey and black shades while providing for the same shelf life as zinc chloride.

Certain zinc salts of sulfonic acids are novel and comprise compounds of our invention. More particularly, the compounds of the invention are of the formula (I) given above, wherein $R_1$ and $R_2$ when taken independently are hydrocarbyl, hydrocarbyl substituted with halogen, or a group of the formula:

$$-NH-R_3$$

wherein $R_3$ is hydrogen or $R_1$ as defined above; and when $R_1$ and $R_2$ are taken together they represent a divalent moiety selected from the group consisting of alkylene, arylene and cycloalkylene. The novel compounds of the invention described above are prepared in the following example.

EXAMPLE 47

To an appropriate vessel there is charged 618 gms (7.6 moles) of zinc oxide in an aqueous slurry. With vigorous stirring there is slowly added to the charge 650 gms (3.8 moles) of p-toluene sulfonic acid in 1 liter of water. The resulting reaction mixture produces an exotherm and heats up to a temperature of circa 100° C. With continued stirring, the mixture is allowed to cool to room temperature and then stood overnight. The crystal precipitate is then separated by filtration, washed and dried to obtain zinc p-toluene sulfonate.

Similarly, repeating the above procedure but replacing the p-toluene sulfonic acid as used therein with equal proportions of o-toluene sulfonic acid, m-benzene disulfonic acid, salicylsulfonic acid, methyl sulfonic acid, 1-hydroxybutane-4-sulfonic acid, chloroethane sulfonic acid, 2-methyl-2-propene-1-sulfonic acid, sulfamic acid and cyclohexyl sulfamic acid, respectively, there are obtained the corresponding zinc salts.

The novel zinc methanesulfonate obtained is characterized in part by a relatively low melting point (circa 50° C.) and is slow to transform from the solid crystalline state to a melt form. This suggests that the zinc methanesulfonate is also useful as a heat-sink, particularly for the absorption and storage of solar energy.

What is claimed is:

1. A method for improving diazotype materials having a light sensitive diazotype coating which comprises a photosensitive diazonium salt, which comprises:

admixing in said coating a stabilizing proportion of a zinc salt of a sulfonic acid.

2. An improved light sensitive diazotype coating, which comprises:

in admixture, a light sensitive diazonium compound and a stabilizing proportion of a zinc salt of a sulfonic acid.

3. The coating of claim 2 wherein the sulfonic acid is an organic compound.

4. The coating of claim 2 wherein the sulfonic acid is sulfamic acid.

5. The coating of claim 2 wherein the sulfonic acid is a compound having the formula:

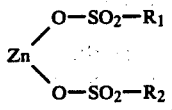

wherein $R_1$ and $R_2$ taken independently represent hydrocarbyl, hydrocarbyl substituted with an inert chemical group, hydroxyl, halogen, or a group of the formula:

$$-NH-R_3$$

wherein $R_3$ is hydrogen or $R_1$ as previously defined; and when taken together, $R_1$ and $R_2$ represent a divalent moiety selected from the group consisting of alkylene, arylene and cycloalkylene.

6. The coating of claim 5 which further comprises an azo dye coupler.

7. The coating of claim 2 wherein the stabilizing proportion is from about 5 gms. to about 200 gms. of the zinc salt for each liter of aqueous diazo coating.

8. A light sensitive diazotype reproduction material which comprises;

a base support; and a coating on the support, which comprises;

in admixture a light sensitive diazonium compound; and a stabilizing proportion of a stabilizer which is a zinc salt of a sulfonic acid.

9. The material of claim 8 wherein the stabilizer is an organic sulfonic acid.

10. The material of claim 8 wherein the stabilizer is zinc sulfamate.

11. The material of claim 10 wherein the stabilizer is a compound having the formula:

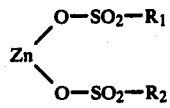

wherein $R_1$ and $R_2$ taken independently represent hydrocarbyl, hydrocarbyl substituted with an inert chemical group, or a group of the formula:

$$-NH-R_3$$

wherein $R_3$ is hydrogen or $R_1$ as previously defined; and when taken together, $R_1$ and $R_2$ represent a divalent moiety selected from the group consisting of alkylene, arylene and cycloalkylene.

12. The material of claim 11 wherein the stabilizer is zinc p-toluene sulfonate.

13. The material of claim 11 wherein the stabilizer is zinc o-toluene sulfonate.

14. The material of claim 11 wherein the stabilizer is zinc m-benzene disulfonate.

15. The material of claim 11 wherein the stabilizer is zinc p-phenol sulfonate.

16. The material of claim 11 wherein the stabilizer is zinc 5-sulfosalicylyate.

17. The material of claim 11 wherein the stabilizer is zinc methane sulfonate.

18. The material of claim 11 wherein the stabilizer is zinc 1-hydroxybutane-4-sulfonate.

19. The material of claim 11 wherein the stabilizer is zinc chloroethane sulfonate.

20. The material of claim 11 wherein the stabilizer is zinc methallyl sulfonate.

21. The material of claim 11 wherein the stabilizer is zinc sulfamate.

22. The material of claim 11 wherein the stabilizer is zinc cyclohexyl sulfamate.

23. The material of claim 11 which further comprises an azo dye coupler.

24. The material of claim 8 wherein the admixture additionally contains a diazonium compound stabilizing proportion of a stabilizing free acid.

* * * * *